US006371145B1

(12) United States Patent
Bardon

(10) Patent No.: US 6,371,145 B1
(45) Date of Patent: Apr. 16, 2002

(54) SYSTEM AND METHOD FOR COMPRESSING A FLUID

(75) Inventor: Patrice C. Bardon, Le Havre (FR)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 09/711,628

(22) Filed: Nov. 13, 2000

Related U.S. Application Data

(60) Provisional application No. 60/222,864, filed on Aug. 4, 2000.

(51) Int. Cl.[7] ..... F04B 49/00

(52) U.S. Cl. ..... 137/1; 137/255; 417/54; 417/119; 417/138

(58) Field of Search ..... 137/255, 1; 417/36, 417/119, 125, 138, 54

(56) References Cited

U.S. PATENT DOCUMENTS

| | | | | |
|---|---|---|---|---|
| 474,338 | A | | 5/1892 | Dyer |
| 3,262,396 | A | | 7/1966 | Kingsbury |
| 3,782,463 | A | | 1/1974 | Palmour |
| 3,829,246 | A | | 8/1974 | Hancock |
| 3,898,866 | A | | 8/1975 | Keyes et al. |
| 4,121,895 | A | | 10/1978 | Watson |
| 4,376,449 | A | | 3/1983 | Nelson et al. |
| 4,678,040 | A | | 7/1987 | McLaughlin et al. |
| 4,686,831 | A | | 8/1987 | Silva |
| 4,781,543 | A | | 11/1988 | Sommer |
| 5,373,897 | A | | 12/1994 | Skarvan |
| 5,511,950 | A | | 4/1996 | Agata |
| 5,738,505 | A | | 4/1998 | Mezzedimi et al. |
| 5,779,451 | A | | 7/1998 | Hatton |
| 5,797,452 | A | | 8/1998 | Martin |
| 5,938,409 | A | | 8/1999 | Radle, Jr. et al. |
| 6,125,882 | A | * | 10/2000 | Kong ..... 137/558 |

OTHER PUBLICATIONS

International Searching Authority, Patent Cooperation Treaty, Notification of Transmittal of The International Search Report or the Declaration, International Application No. PCT/US00/34328, Apr. 5, 2001, 6 pages.

* cited by examiner

*Primary Examiner*—Kevin Lee
(74) *Attorney, Agent, or Firm*—Haynes and Boone, LLP

(57) ABSTRACT

A fluid pressurizing system and method according to which a fluid at a low pressure is compressed by fluid to increase its pressure to enable it to be discharged from the system and to an external delivery point.

54 Claims, 1 Drawing Sheet

SYSTEM AND METHOD FOR COMPRESSING A FLUID

CROSS REFERENCE TO RELATED APPLICATION

This application claims priority of provisional application Ser. No. 60/222,864 filed on Aug. 4, 2000.

GENERAL DESCRIPTION

This invention relates to a system and method for compressing fluid to enable it to be discharged from the system and transferred to an external delivery point.

DETAILED DESCRIPTION

Figure 1:
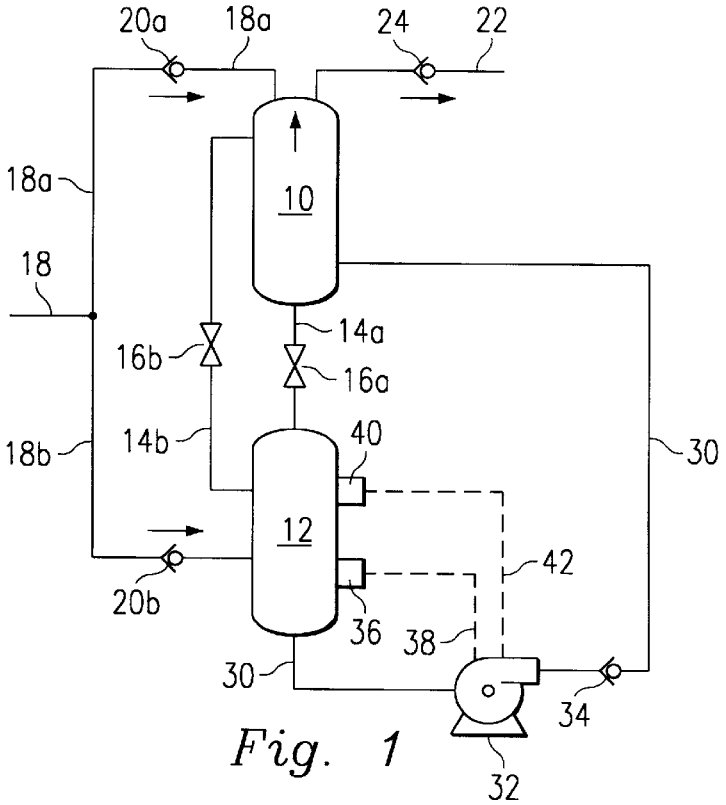
FIGS. 1 and 2 diagrammatic views depicting two alternative embodiments of the system and method of the present invention.

Referring to FIG. 1 of the drawings, two fluid reservoirs 10 and 12 are provided with the reservoir 10 located above the reservoir 12. The lower portion of the reservoir 10 is connected to the reservoir 12 by a fluid flow line 14*a*, and the upper portion of the reservoir 10 is connected to the reservoir 12 by a flow line 14*b*. Two valves 16*a* and 16*b* are disposed the flow lines 14*a* and 14*b*, and are movable between an open position in which they permit fluid flow through the lines 14*a* and 14*b*, respectively, and, a closed position in which they prevent flow though the lines.

A relatively low-pressure fluid is introduced into the reservoirs 10 and 12 through a flow line 18 and two branch flow lines 18*a* and 18*b*, respectively. The fluid can be a single-phase fluid, i.e., either liquid or gas, or a biphase fluid containing liquid and gas, such as an unprocessed fluid from a subsurface well. Two check valves 20*a* and 20*b* are disposed in the branch flow lines 18*a* and 18*b*, respectively, to insure unidirectional flow through the flow lines in a direction indicated by the arrows.

A discharge flow line 22 extends from the reservoir 10, and a check valve 24 is disposed in the flow line 22 to insure unidirectional flow through the flow line in a direction indicated by the arrow.

Another flow line 30 extends from the bottom of the reservoir 12 to the bottom of the reservoir 10, and a rotary pump 32 is connected in the flow line 30 to pump the fluid from the reservoir 12 to the reservoir 10. A check valve 34 is located in the line 30 to insure unidirectional flow of the fluid through the flow line 30.

A level control unit 36 is associated with the lower portion of the reservoir 12 and operates in a conventional manner to sense the level in the reservoir falling below a predetermined value and generate an output signal. The unit 36 is connected to the pump 32, via an electrical conductor 38 (shown dashed), and a sensor, or the like, (not shown) is associated with the pump, and is connected to the conductor 38, for responding to the output signal and shutting down the pump when the fluid level in the reservoir falls below the predetermined value.

The unit 36 is also electrically connected to the valve 16*a*, via a branch of the electrical conductor 38; and a sensor, or the like (not shown), is associated with the latter valve and is connected to the branch conductor, for responding to the latter output signal and operating the valve in a manner to be described. It is also understood that the level control unit 36 can also be connected to the valve 16*b* in a similar manner to operate the valve, but this is not shown in FIG. 1 in the interest of clarity.

A level control unit 40 is associated with the upper portion of the reservoir 12 and operates in a conventional manner to sense the level in the reservoir rising above a predetermined value and general an output signal. The unit 40 is electrically connected to the pump 32, via an electrical conductor 42 (shown dashed); and a sensor, or the like (not shown) is associated with the pump, and is connected to the conductor 42, for responding to the latter output signal and starting the pump when the fluid level in the reservoir rises above the predetermined value.

The unit 40 is also electrically connected to the valve 16*a*, via a branch of the electrical conductor 42; and a sensor, or the like (not shown), is associated with the latter valve and is connected to the branch conductor, for responding to the latter output signal and operating the valve in a manner to be described. It is also understood that the level control unit 40 can also be connected to the valve 16*b* in a similar manner to operate the valve, but this is not shown in FIG. 1 in the interest of clarity.

In operation, it will be assumed that the system is in an inactive mode, and the reservoirs 10 and 12 contain a biphase fluid at the inlet pressure in line 18. The liquid portion of the biphase fluid in both reservoirs 10 and 12 descends to the lower portion of each reservoir by gravity and the gaseous portion accumulates in the upper portion of each reservoir.

At the beginning of the cycle, the valves 16*a* and 16*b* are closed and additional fluid is introduced into the reservoirs 10 and 12, via the flow lines 18*a* and 18*b*, or by fluid from an external source until the fluid level in the reservoir 12 reaches the above-mentioned, predetermined, relatively high level so that the control unit 40 responds and activates the pump 32.

The pump 32 thus pumps the liquid in the lower portion of the reservoir 12 through the flow line 30, to the lower portion of the reservoir 10. This liquid entering the reservoir 10 compresses the liquid and gas in the latter reservoir to increase the fluid pressure in the reservoir 10. When the pressure in the reservoir 10 exceeds the downstream pressure at the discharge check valve 24, the fluid in the upper portion of the reservoir 10, which is largely gas, is displaced from the reservoir 10 into and through the discharge flow line 22. Also, since the fluid level in the reservoir 10 will increase, some liquid will also flow into and through the discharge flow line 22. Since this fluid in the discharge flow line 22 is at a relatively high pressure, it can flow to an external delivery point.

During the above operation, the pressure in the reservoir 10 is increased and the pressure in the reservoir 12 is reduced. When the pressure in the reservoir 12 reduces to a value that is lower than the pressure in the line 18, additional fluid from the line 18 passes into the reservoir 12, via the flow line 18*b*. This operation continues until the fluid level in the reservoir 12 drops to a predetermined, relatively low, level as sensed by the level control unit 36. When this happens, the pump 32 is turned off in the manner described above.

The valves 16*a* and 16*b* are then opened to respectively allow the fluid, which is largely liquid, in the lower portion of the reservoir 10 to flow, by gravity, to the reservoir 12 via the flow line 14*a*, and the fluid, which is largely gas, in the upper portion of the reservoir 10 to flow, via the flow line 14*b*, to the reservoir 12, to replace the displaced liquid in the reservoir and equalize the pressures between the reservoirs 10 and 12. When this occurs, the system reaches the inactive state, as discussed above, and is ready for a new cycle.

Figure 2:
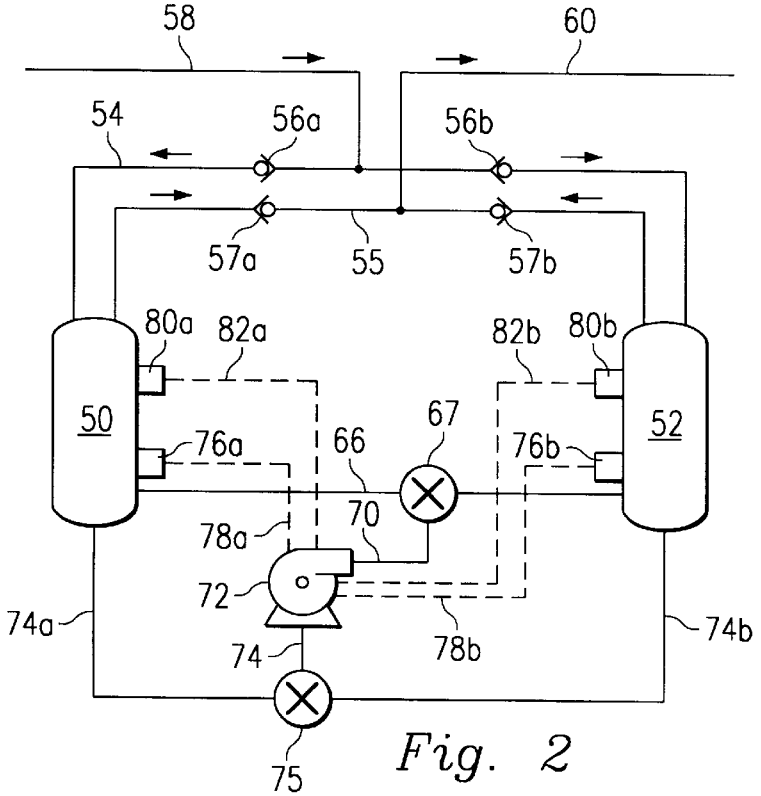

An alternate embodiment is shown in FIG. 2 according to which two fluid reservoirs 50 and 52 are provided in a side-by-side relationship with their respective upper portions being connected together by two flow lines 54 and 55. Two check valves 56*a* and 56*b* are connected in the flow line 54 and two check valves 57*a* and 57*b* are connected in the flow line 55. The check valves 56*a*, 56*b*, 57*a*, and 57*b* are constructed and arranged in a manner to permit unidirectional flow through the flow lines 54 and 55 in a direction indicated by the arrows.

A flow line 58 connects with the flow line 54, and a discharge flow line 60 extends from the flow line 55. A fluid is selectively introduced into the reservoirs 50 and/or 52, via the line 58, and fluid discharges from the reservoirs via the line 60 under conditions to be described. The fluid can be a single-phase fluid, i.e., either liquid or gas, or a biphase fluid consisting of liquid and gas, such as an unprocessed fluid from a subsurface well.

A flow line 66 also connects the lower portions of the reservoirs 50 and 52, and a three-way valve 67 is connected to the flow line 66. A flow line 70 extends between the valve 67 and a rotary pump 72 that is switchable between two operating modes in which it pumps liquid in two directions, respectively, in a manner to be described. A flow line 74 is also connected to the pump 72 and splits into two branch flow lines 74*a* and 74*b*, with a three-way valve 75 being located at the junction between the flow lines 74, 74*a* and 74*b*. The flow lines 74*a* and 74*b* extend from the valve 75 to the lower portions of the reservoirs 50 and 52, respectively.

It is understood that the three-way valves 67 and 75 are mechanically connected in tandem and, as such, move together between a first position in which each valve permits fluid flow in one direction, a second position in which each valve permits fluid flow in an opposite direction, and a third, closed position in which each valve prevents any flow. Since these valves 67 and 75 are conventional they will not be described in any further detail.

Two level control units 76*a* and 76*b* are associated with the lower portions of the reservoir 50 and 52, respectively, and each operates in a conventional manner to sense the level in its corresponding reservoir falling below a predetermined value and generate an output signal. The units 76*a* and 76*b* are connected to the pump 72, via two electrical conductors 78*a* and 78*b*, respectively (shown dashed). A sensor, or the like (not shown), is associated with the pump 72 and is connected to the conductors 78*a* and 78*b* for responding to the output signal when the fluid level in either reservoir 50 and 52 falls below the above-mentioned predetermined value for shutting off the pump or reversing the pumping direction of the pump, respectively, as will be described.

A sensor, or the like (not shown), is associated with the valve 67 and is connected to the level control units 76*a* and 76*b*, via branches of conductors 78*a* and 78*b*. The latter sensor also responds to the output signal when the fluid level in either reservoir 50 and 52 falls below the above-mentioned predetermined value for moving the valve 67 to a position to be described. Since the valves 67 and 75 are mechanically connected, movement of the valve 67 causes corresponding movement of the valve 75.

Two level control units 80*a* and 80*b* are associated with the upper portion of the reservoirs 50 and 52, respectively, and each operates in a conventional manner to sense the level in its corresponding reservoir rising above a predetermined value and generate an output signal. The units 80*a* and 80*b* are also connected to the pump 72, via two electrical conductors 82*a* and 82*b*, respectively (shown dashed). A sensor, or the like (not shown) is associated with the pump 72 and is connected to the conductors 82*a* and 82*b* for responding to the latter output signal and starting the pump when the fluid level in the reservoir 50 and 52 rises above the above-mentioned predetermined value. The level control units 80*a* and 80*b* are used exclusively during the start-up of the system which will be described.

In operation, it will be assumed that the system is in an inactive mode, and that the reservoirs 50 and 52 contain a biphase fluid at the inlet pressure in line 58. As in the previous embodiment, the liquid portion of the biphase fluid in both reservoirs 50 and 52 descend to the lower portion of each reservoir by gravity and the gaseous portion accumulates in the upper portion of each reservoir. It will also be assumed that the valves 67 and 75 are in their first position described above which permits flow from the reservoir 50 to the reservoir 52 in a manner to be described.

At the beginning of the cycle, the liquid levels in the reservoirs 50 and 52 are raised by natural through flow from the line 58 to the line 54 or by adding liquid from an external source. If the fluid level in the reservoir 50 reaches the level of the control unit 80*a* before the fluid level in the reservoir 52 reaches the level of the control unit 80*b*, the control unit 80*a* outputs a signal to the sensor in the pump 72 to activate it in its first operating mode as discussed above. The pump 72 pumps the liquid in the lower portion of the reservoir 50 through the flow line 74*a*, the valve 75, the flow line 74, the pump, and the flow line 70; and through the valve 67 and the flow line 66 to the reservoir 52.

The liquid entering the reservoir 52 compresses the fluid in the latter reservoir to increase the fluid pressure in the reservoir. When the pressure in the reservoir 52 exceeds the downstream pressure at the discharge check valve 57*b*, the fluid in the reservoir 52 is displaced from the reservoir through the line 55 and flows though the discharge flow line 60 to an external delivery point.

During the above operation, the pressure in the reservoir 52 is increased and the pressure in the reservoir 50 is reduced. When the pressure in the reservoir 50 reduces to a value that is lower than the pressure in the lines 58 and 54, additional fluid from the lines 58 and 54 is introduced into the reservoir 50.

This operation continues until the fluid level in the reservoir 50 drops to a predetermined, relatively low, level as sensed by the level control unit 76*a*. When this happens, the pump 72 is switched to its second operating mode discussed in which it pumps fluid in a direction opposite the direction of flow discussed above. The valves 67 and 75 are also moved to their second position described above. This permits the flow of the fluid in the reservoir 52 through the line 74*b*, the valve 75, the line 74, the pump and the line 70; and through the valve 67 to the line 66 and the reservoir 50. This flow continues until the control unit 76*b* detects the fluid level in the reservoir 52 falling below the predetermined value and outputs a signal to the sensor associated with the valve 67, thus causing the pump 72 to either be switched back to its first operating mode or to be switched off, and the valves 67 and 75 to move back to their first position. When this occurs, the system is ready for a new cycle.

If, at the beginning of the cycle described above, the fluid level in the reservoir 52 reaches the level of the control unit

80*b* before the fluid level in the reservoir 50 reaches the level of the control unit 80*a*, the control unit 80*b* outputs a signal to the sensor in the pump 72 to activate it (assuming that it had been turned off in the previous cycle). Since the valves 67 and 75 are already in their second position discussed above, the pump 72 pumps the liquid in the lower portion of the reservoir 52 through the flow line 74*b*, the valve 75, the flow line 74, the pump, and the flow line 70, and through the valve 67 and the flow line 66 to the reservoir 50. This liquid entering the reservoir 50 compresses the fluid in the latter reservoir to increase the fluid pressure in the reservoirs. When the pressure in the reservoir 50 exceeds the downstream pressure at the discharge check valve 57*a*, the fluid in the reservoir 50 is displaced from the reservoir through the line 55 and the discharge flow line 60.

During the above operation, the pressure in the reservoir 50 is increased and the pressure in the reservoir 52 is reduced. When the pressure in the reservoir 52 reduces to a value that is lower than the pressure in the lines 58 and 54, additional fluid from the lines 58 and 54 is introduced into the reservoir 52.

This operation continues until the fluid level in the reservoir 52 drops to a predetermined, relatively low, level as sensed by the level control unit 76*b*. When this happens, the pump 72 is switched to its first operating mode, and the valves 67 and 75 are moved to their first position. Thus, fluid flows from the reservoir 50 through the line 74*a*, the valve 75, the line 74, the pump and the line 70, and through the valve 67 to the line 66 and the reservoir 52. This continues until the control unit 76*ba* detects the fluid level in the reservoir 50 falling below the predetermined value and causes the pump 72 to either be switched back to its second operating mode or to be switched off, and the valves 67 and 75 to move back to their second position. When this occurs, the system is ready for a new cycle.

It is understood that, when the system is initially started up, if the level in the reservoir 50 is not at its maximum which corresponds to the height of the control unit 80*a*, production can start as long as the level in the reservoir 50 is at of above the level of the control units 76*a*. In this case, it will take several cycles before an optimum operation is achieved which will occur as soon as the level of liquid in the reservoir 50 reaches the above-mentioned maximum height. This is also applicable to the reservoir 52.

VARIATIONS

Variations may be made in both of the foregoing embodiments, without departing from the scope of the invention. The following are examples of some variations:

1. In the first embodiment described above, at the end of the pumping phase, instead of opening the valves 16*a* and 16*b*, the pump 32 could be connected in a manner to pump the fluid from the reservoir 10 to the reservoirs 12.
2. The end of the discharge lines 20 and 55 in the interiors of the reservoirs 10 and 50 can be placed at various levels to insure optimum operation.
3. A multi-reservoir installation can be provided in which the reservoirs 12 and 52 would serve a series of two or more reservoirs similar to the reservoir 10 and 50, respectively, in which case, while pumping the liquid from the bottom of one of the reservoirs of the series of reservoirs 10 and 50, the valves associated with the other reservoirs would be open.
4. The inlet check valves 20*a* and 20*b*; and/or the discharge check valve 24 can be replaced by on/off process valves.
5. The pumps 32 and 72 can be multistage centrifugal pumps.
6. In the embodiment of FIG. 2 two separate pumps can be associated with the reservoirs 50 and 52 respectively.
7. A bladder, or the like can be provided to isolate the liquid from the gas in the reservoirs 10 and 50.
8. The system and method of the present invention is not limited to use with a biphase fluid nor to hydrocarbon recovery systems that process well fluid, but is equally applicable to an environment in which any type of single phase fluid is to be compressed.
9. Although the expression "reservoirs" were used above, it is understand that any devices, such as tanks, vessels drums, containers, etc. can be used to contain the fluid.
10. Although the expression "flow lines" were used above, it is understand that any devices, such as pipes, conduits, tubes, hoses, etc. can be used to transfer the fluid.

Since other variations, changes, and substitutions are intended in the foregoing disclosure, it is appropriate that the appended claims be construed broadly and in a manner consistent with the scope of the invention.

What is claimed is:

1. A fluid system comprising a first and a second reservoir for receiving a fluid, a discharge line extending from the first reservoir, a first flow line connecting the second reservoir to the first reservoir for transferring fluid from the second reservoir to the first reservoir under pressure for compressing the fluid in the first reservoir and displacing it from the first reservoir into the discharge line, a second flow line connecting the first reservoir to the second reservoir, and a pump for pumping the fluid in the first reservoir, through the first flow line, to the second reservoir.

2. The system of claim 1 wherein the fluid flows from the first reservoir, through the second flow line, and to the second reservoir by gravity.

3. The system of claim 1 further comprising a control unit associated with the second reservoir and connected to the pump for responding to the fluid level in the second reservoir and controlling the operation of the pump.

4. The system of claim 3 wherein the control unit responds to the fluid level in the second reservoir falling below a predetermined value.

5. The system of claim 3 wherein the control unit responds to the fluid level in the second reservoir rising above a predetermined value.

6. The system of claim 3 further comprising a flow control valve disposed in the first flow line and movable between a first position in which it permits fluid flow through the first flow line and a second position in which it prevents fluid flow through the first flow line.

7. The system of claim 6 wherein the control unit is connected to the flow control valve for responding to the fluid level in the second reservoir and controlling the operation of the flow control valve.

8. The system of claim 1 wherein the pump also pumps the fluid from the second reservoir, through the second flow line, and to the first reservoir.

9. The system of claim 8 further comprising two flow control valves respectively connected in the first and second flow lines for selectively permitting the fluid to flow from the second reservoir, through the first flow line to the first reservoir; or from the first reservoir, through the second flow line to the second reservoir.

10. A fluid flow method comprising introducing a fluid into a first reservoir and into a second reservoir, moving a flow control valve between a first position in which it permits fluid flow from the second reservoir to the first reservoir under pressure for compressing the fluid in the first reservoir and displacing the fluid from the first reservoir into a discharge line and a second position in which it prevents fluid flow from the second reservoir to the first reservoir, and transferring a portion of the remaining portion of the fluid in the first reservoir to the second reservoir.

11. The method of claim 10 wherein the fluid is transferred from the first reservoir to the second reservoir by gravity.

12. The method of claim 12 further comprising controlling the pumping in response to a predetermined fluid level in the second reservoir.

13. The method of claim 12 further comprising controlling the pumping in response to the fluid level in the second reservoir falling below a predetermined value.

14. The method of claim 12 further comprising controlling the pumping in response to the fluid level in the second reservoir rising above a predetermined value.

15. The method of claim 10 further comprising controlling the operation of the flow control valve in response to liquid level in the second reservoir attaining a predetermined value.

16. The method of claim 10 further comprising pumping the fluid from the first reservoir to the second reservoir.

17. The method of claim 16 and wherein the steps of pumping are performed by a single pump.

18. The method of claim 17 further comprising operating two flow control valves to selectively flow fluid from the second reservoir to the first reservoir; or to flow fluid from the first reservoir to the second reservoir.

19. The method of claim 10 wherein the fluid is a biphase fluid and wherein the liquid portion of the fluid is separated from the gaseous portion in each reservoir.

20. A fluid system comprising a first and a second reservoir for receiving a fluid, a discharge line extending from the first reservoir, a first flow line connecting the second reservoir to the first reservoir, a pump for pumping fluid from the second reservoir to the first reservoir under pressure for compressing the fluid in the first reservoir and displacing it from the first reservoir into the discharge line, a second flow line connecting the first reservoir to the second reservoir, the pump pumping fluid in the first reservoir to the second reservoir, and two flow control valves respectively connected in the first and second flow lines for selectively permitting the fluid to flow from the second reservoir, through the first flow line to the first reservoir; or from the first reservoir, through the second flow line to the second reservoir.

21. The system of claim 20 further comprising a control unit associated with each reservoir and connected to the pump for responding to the fluid level in the reservoirs and controlling the operation of the pump.

22. The system of claim 21 wherein the control unit is connected to the flow control valves, responds to the fluid level in the reservoirs, and controls the operation of the flow control valves.

23. A fluid flow method comprising pumping fluid from a first reservoir to a second reservoir under pressure for compressing the fluid in the second reservoir and displacing it from the second reservoir into the discharge line, responding to the fluid in the first reservoir falling below a predetermined volume and pumping fluid from the second reservoir to the first reservoir under pressure for compressing the fluid in the first reservoir and displacing it from the first reservoir.

24. The method of claim 23 further comprising responding to the fluid in the second reservoir falling below a predetermined volume and pumping fluid from the first reservoir to the second reservoir under pressure for compressing the fluid in the second reservoir and displacing it from the second reservoir.

25. A fluid system comprising a first and a second reservoir for receiving a fluid, a discharge line extending from the first reservoir, a first flow line connecting the second reservoir to the first reservoir for transferring fluid from the second reservoir to the first reservoir under pressure for compressing the fluid in the first reservoir and displacing it from the first reservoir into the discharge line, and a second flow line connecting the first reservoir to the second reservoir for transferring fluid in the first reservoir to the second reservoir; wherein the fluid is a biphase fluid and the liquid portion of the biphase fluid is separated from the gaseous portion in each reservoir.

26. A fluid flow method comprising introducing a fluid into a first reservoir and into a second reservoir, transferring fluid from the second reservoir to the first reservoir under pressure for compressing the fluid in the first reservoir and displacing fluid from the first reservoir into a discharge line, and pumping a portion of the remaining portion of the fluid in the first reservoir to the second reservoir.

27. The method of claim 26 further comprising controlling the pumping in response to a predetermined fluid level in the second reservoir.

28. The method of claim 26 further comprising controlling the pumping in response to the fluid level in the second reservoir falling below a predetermined value.

29. The method of claim 26 further comprising controlling the pumping in response to the fluid level in the second reservoir rising above a predetermined value.

30. The method of claim 26 further comprising moving a valve between a first position in which it permits fluid flow from the second reservoir to the first reservoir, and a second position in which it prevents fluid flow from the second reservoir to the first reservoir.

31. The method of claim 30 further comprising controlling the movement of the valve in response to liquid level in the second reservoir attaining a predetermined value.

32. The method of claim 30 further comprising sensing the fluid level in the second reservoir and controlling the operation of the valve.

33. The method of claim 26 further comprising pumping the fluid from the second reservoir to the first reservoir.

34. The method of claim 33 wherein the steps of pumping are performed by the same pump.

35. The method of claim 33 further comprising operating two flow control valves to selectively permit flow fluid from the second reservoir to the first reservoir; or to selectively permit flow fluid from the first reservoir to the second reservoir.

36. A fluid system comprising a first and a second reservoir for receiving a fluid, a discharge line extending from the first reservoir, a first flow line connecting the second reservoir to the first reservoir for permitting flow of the fluid from the second reservoir to the first reservoir under pressure for compressing the fluid in the first reservoir and displacing it from the first reservoir into the discharge line, and a second flow line connecting the first reservoir to the second reservoir for permitting the flow of fluid in the first reservoir to the second reservoir, and a flow control valve disposed in the first flow line and movable between a first position in which it permits fluid flow through the first flow line and a second position in which it prevents fluid flow through the first flow line.

37. The system of claim 36 wherein the fluid flows from the first reservoir, through the second flow line, and to the second reservoir by gravity.

38. The system of claim 36 further comprising a pump for pumping the fluid from the first reservoir, through the second flow line, and to the second reservoir.

39. The system of claim 38 further comprising a control unit associated with the second reservoir and connected to the pump for responding to the fluid level in the second reservoir and controlling the operation of the pump.

40. The system of claim 39 wherein the control unit responds to the fluid level in the second reservoir falling below a predetermined value.

41. The system of claim 39 wherein the control unit responds to the fluid level in the second reservoir rising above a predetermined value.

42. The system of claim 38 wherein the pump also pumps the fluid from the second reservoir, through the first flow line, and to the first reservoir.

43. The system of claim 36 further comprising a sensor for responding to the fluid level in the second reservoir and controlling the operation of the flow control valve.

44. The system of claim 36 further comprising a flow control valve disposed in the second flow line and movable between a first position in which it permits fluid flow through the second flow line, and a second position in which it prevents fluid flow through the second flow line.

45. The system of claim 44 further comprising a sensor for responding to the fluid level in the first reservoir and controlling the operation of the latter flow control valve.

46. The system of claim 36 wherein the fluid is a biphase fluid and the liquid portion of the biphase fluid is separated from the gaseous portion in each reservoir.

47. A fluid system comprising a first and a second reservoir for receiving a fluid; a first discharge line extending from the first reservoir; a second discharge line extending from the second reservoir; a first flow line connecting the second reservoir to the first reservoir for permitting flow of the fluid from the second reservoir to the first reservoir under pressure for compressing the fluid in the first reservoir and displacing it from the first reservoir into the first discharge line; a second flow line connecting the first reservoir to the second reservoir for permitting flow of the fluid from the first reservoir to the second reservoir under pressure for compressing the fluid in the second reservoir and displacing it from the second reservoir into the second discharge line; and means for selectively flowing fluid from the second reservoir to the first reservoir, and from the first reservoir to the second reservoir in response to the fluid level in a reservoir.

48. The system of claim 47 wherein the means comprises a pump connected in the flow lines.

49. The system of claim 48 wherein a portion of the first flow line forms a portion of the second flow line, and wherein the pump is in the portion of the flow lines.

50. The system of claim 48 further comprising a control unit associated with each reservoir and connected to the pump for responding to the fluid level in each reservoir and controlling the operation of the pump.

51. The system of claim 50 wherein the control units respond to the fluid level in the reservoirs falling below a predetermined value.

52. The system of claim 50 wherein the control units respond to the fluid level in the reservoirs rising above a predetermined value.

53. The system of claim 47 wherein the means further comprises first and second flow control valves connected in the first and second flow lines, respectively, for selectively controlling the fluid flow through the first and second flow lines, respectively.

54. The system of claim 53 further comprising a sensor for responding to the fluid level in the first reservoir and controlling the operation of the first flow control valve, and a sensor for responding to the fluid level in the second reservoir and controlling the operation of the second flow control valve.

* * * * *